US007526819B2

(12) United States Patent
Beaupré

(10) Patent No.: US 7,526,819 B2
(45) **Date of Patent: *May 5, 2009**

(54) DUAL FLUSH SYSTEM FOR TOILET

(76) Inventor: Pierre Beaupré, 1685 Route Edouard VII App. 6, Saint-Philippe, Quebec J0L 2K0 (CA)

( * ) Notice: Subject to any disclaimer, the term of this patent is extended or adjusted under 35 U.S.C. 154(b) by 0 days.

This patent is subject to a terminal disclaimer.

(21) Appl. No.: 12/019,941

(22) Filed: Jan. 25, 2008

(65) Prior Publication Data

US 2008/0115262 A1 May 22, 2008

Related U.S. Application Data

(63) Continuation-in-part of application No. 11/531,861, filed on Sep. 14, 2006.

(30) Foreign Application Priority Data

Sep. 19, 2006 (CA) ..... 2557956

(51) Int. Cl.
*E03D 3/12* (2006.01)

(52) U.S. Cl. ..... 4/327

(58) Field of Classification Search ..... 004/327
See application file for complete search history.

(56) References Cited

U.S. PATENT DOCUMENTS

| | | | | | |
|---|---|---|---|---|---|
| 3,186,007 | A | * | 6/1965 | Falotico | 4/327 |
| 3,758,893 | A | * | 9/1973 | Smolinski et al. | 4/327 |
| 3,839,747 | A | * | 10/1974 | Clark | 4/327 |
| 3,916,455 | A | * | 11/1975 | Longdin | 4/327 |
| 4,115,882 | A | * | 9/1978 | Paulus | 4/327 |
| 4,185,338 | A | * | 1/1980 | Bresnyan | 4/327 |
| 4,216,555 | A | | 8/1980 | Detjen | |
| 4,504,984 | A | | 3/1985 | Burns | |
| 5,175,893 | A | | 1/1993 | Navarrete | |
| 5,966,749 | A | | 10/1999 | Goesling | |
| 6,510,563 | B1 | | 1/2003 | Jarosinski | |
| 6,775,859 | B1 | | 8/2004 | Gorginians | |
| 7,062,801 | B2 | | 6/2006 | Oliver | |

* cited by examiner

*Primary Examiner*—Charles E Phillips
(74) *Attorney, Agent, or Firm*—Robert Brouillette; Brouillette & Partners LLP

(57) ABSTRACT

The conservation of water is an issue that preoccupies an increasing number of people. Among all domestic appliances, toilet is an appliance that consumes an appreciable quantity of water. The present invention provides a dual flush system that allows to select the volume of water when using a toilet by choosing between two volumes of water. The dual flush system can be easily installed without tools on a toilet.

21 Claims, 9 Drawing Sheets

DUAL FLUSH SYSTEM FOR TOILET

CROSS-REFERENCE TO RELATED APPLICATIONS

The present Patent Application is a continuation-in-part of the U.S. patent application Ser. No. 11/531,861 filed on Sep. 14, 2006.

The present patent application claims the benefits of priority of commonly assigned U.S. Provisional Application No. 60/750,371 entitled "Dual flush system for toilet" filed at the USPTO on Dec. 15, 2005. The present patent application claims the benefits of priority of commonly assigned U.S. patent application Ser. No. 11/531,861, entitled "Dual Flush System for Toilet" and filed at the USPTO on Sep. 14, 2006. The present patent application claims the benefits of priority of commonly assigned Canadian Patent Application No. 2,557,956, entitled "Dual Flush System for Toilet" and filed at the CIPO on Sep. 19, 2006.

FIELD OF THE INVENTION

The present invention generally relates to toilets flush systems.

BACKGROUND OF THE INVENTION

The use of toilet flushing devices is known in the prior art. There is a growing consciousness of the need to conserve water, particularly in toilets where it is not always necessary to have a full flushing of the toilet. In order to conserve flushing water, attempts have been made at providing two flushing modes.

In conventional toilets, there is often provided in the water tank a tank-ball or flapper that can engage the annular seat formed by the flush pipe outlet. The tank-ball is linked by means of a lift chain to a lever pivotally mounted to the water tank inner wall. A flush actuator, usually a handle located outside the water tank controls the lever. As known in the art, upon the flush handle being pivoted from a rest position to an operative position, the lever will pull on the lift chain which in turn will raise the tank-ball from its seat to allow the water inside the water tank to flow into the toilet bowl. A water supply valve will allow water to be fed into the water tank until a float ball, connected to the supply valve, reaches a determined position in the water tank, at which point the supply valve will be closed. It is noted that the tank-ball is pivotally attached to the base of the overflow tube to pins, this simply as a matter of convenience since the overflow pipe extends closely adjacent to the flush pipe outlet. Also, the tank-ball is slightly buoyant, such that it will remain spaced from the flush pipe outlet while the water in the water tank flows out into the toilet bowl, but the combined action of the gravity and a suction effect from the flush pipe when the last water flows out through the flush pipe, will bias the tank-ball to engage its seat and seal the flush pipe outlet once the water tank is empty, to allow the water tank to be re-filled with water.

Indeed, toilets are conventionally made to allow a full flush to be accomplished, although this is not always necessary.

Providing a selective dual flush system as contemplated by this invention would allow considerable water volumes to be saved.

OBJECTS OF THE INVENTION

Accordingly, a first object of the present invention is to provide a dual flush system for toilets allowing the user of the toilet to calibrate how much water he/she wishes to use when flushing the toilet.

Another object of the present invention is to provide a dual flush system which may be installed on existing toilets without modification of the latter.

A further object of the present invention is to provide a dual flush system which is inexpensive.

A still further object of the present invention is to provide a dual flush system which is easily installed without tools, and needs low maintenance.

Other and further objects and advantages of the present invention will be obvious upon an understanding of the illustrative embodiments about to be described or will be indicated in the appended claims, and various advantages not referred to herein will occur to one skilled in the art upon employment of the invention in practice.

SUMMARY OF THE INVENTION

According to the present invention, there is provided a dual flush system for a toilet to allow a user to calibrate how much water he/she wishes to use when flushing the toilet. Either a partial flush if the flush handle is pivoted to its first position or a full flush if the flush handle is pivoted to its second position. Alternatively, two different flush handles could be provided, one for a partial flush and a second for a full flush.

In use, if the toilet flush handle is pivoted from its rest position to a first predetermined position, the lever will in turn be pivoted and will pull upwardly on lift chain to raise the tank-ball from its seated to its lifted position, spacedly over a flush pipe extension and out of its sealed engagement with the flush pipe extension. This will allow water in the toilet water tank to flow through the coextensive flush pipe extension and flush pipe into the toilet bowl. However, it is understood that the entire water tank would not be emptied into the toilet bowl if only the tank-ball is raised by lift chain, since the height of flush pipe extension would prevent this from happening. More specifically, when tank-ball is raised from its seated to its lifted position while flush pipe extension remains in its lower position, water is allowed to drain from the toilet water tank until it reaches a level within the water tank which is equal to the position of the second flush outlet, which is higher than the first flush outlet.

Upon the flush handle being pivoted from its rest position to a second predetermined position which is angularly beyond than its first predetermined position, the lever will in turn be pivoted further and will pull upwardly on lift chain to first raise the tank-ball from its seated to its lifted position and to further raise flush pipe extension from its lower to its upper position. More particularly, as the tank-ball is gradually lifted by lift chain, the tank-ball will first reach its lifted position and further pulling on tank-ball will raise the guiding part along overflow tube, effectively moving the flush pipe extension from its lower to its upper position. This will allow water in the toilet water tank to flow through the flush pipe into the toilet bowl.

Consequently, if the flush handle is only pivoted from its rest position to its first position, then the water tank will be partly drained into the toilet bowl, since the water level will only be allowed to lower until it reaches the second flush outlet. However, if the flush handle is pivoted from its rest to its second position, then the water tank will be entirely drained due to the flush pipe extension being raised to its upper position spacedly above the first flush outlet. With a double handle system, each handle is connected to one of the flush outlets.

It is noted that the dual flush system of the present invention can be simply retrofitted into a conventional toilet water tank. Indeed, to do so, the user simply needs to remove the existing tank-ball from a pair of pins provided at the lower extremity of overflow tube, and to which the tank-ball is conventionally releasably attached. The guiding part is then inserted along overflow tube, and the tank-ball is pivotally installed onto pins provided on the guiding part. Finally, the lift chain simply needs to be shortened to compensate for the height of the flush pipe extension. Alternately, a new tank-ball could be provided with the dual flush system, the former tank-ball being disposed of.

Also, it is further noted that the presence of the downwardly convergent alignment arm allows the flush pipe extension to be self-centering and auto-aligning with respect to the flush pipe due to the sliding engagement of alignment arm along the flush pipe if any positional offset of the flush pipe extension was to occur while it moves away or towards the flush pipe. The alignment arm thus ensures that the flush pipe extension bottom opening will systematically come into a sealed engagement with the first flush outlet when the flush pipe extension is in its lower position. Furthermore, the buoyant member can be undersized on one side or even absent to fit to more toilets models. Because the distance between the wall of the water tank and the flush pipe may vary, the buoyant member can be thinner on the side of the wall of the water tank fit to a majority of toilets or may even be located on only one side of the flush pipe.

The dual flush system of the present invention also provides for the tank-ball to return to its seated position once a partial flush is completed. The same is also provides for the tank-ball to return to its seated position and for flush pipe extension to return to its lower position once a full flush is completed.

Indeed, while a partial flush is under way, the buoyant tank-ball will float in the water above the second flush outlet, thus remaining in its lifted position. Once the water level in the water tank reaches the position of the second flush outlet, the tank-ball will also reach the second flush outlet under the effect of gravity. The suction effect of the water flowing down into the toilet bowl will draw the tank-ball, now not being countered by its buoyancy, into a tight, sealed engagement against the second flush outlet.

Likewise, while a full flush is under way, the buoyant tank-ball will remain in its lifted position until the water level reaches the position of the second flush outlet. The flush pipe extension will also remain in its raised position due to the buoyant member maintaining the flush pipe extension above the first flush outlet. While the water level first reach the level of the second flush outlet and continue to drain from the water tank between the raised flush pipe extension and the flush pipe, tank-ball will return to its seated position against the second flush outlet. Then, when the water level reaches the position of the first flush outlet, the flush pipe extension, not being countered by its own buoyancy, will engage the first flush outlet under the effect of gravity. The suction effect of the water flowing down into the toilet bowl will draw the tank-ball into a tight, sealed engagement against the second flush outlet, and with the flush pipe extension thus sealingly covered by the tank-ball, the flush pipe extension will also be drawn into a tight, sealed engagement against the first flush outlet.

The buoyancy of both the tank-ball and the buoyant member are just sufficient to counter the effect of gravity respectively on the tank-ball and the flush pipe extension. Thus, the tank-ball and flush pipe extension are not forced towards the water line, but will simply be maintained in a floating position when they are forced away from their respective seated and lower positions by the lift chain. The buoyancy is provided by a tight cavity enclosing air or any suitable buoyant material.

It is understood that the height of the flush pipe extension can be chosen according to the desired relative volume of water which is to be flushed with a partial flush. An adjustable tank ball may also be used in combination with the dual flush system of the present invention. This allows a better control of the quantity of water to evacuate when flushing. A tank ball as described in the U.S. Pat. No. 5,966,749 entitled 'Adjustable flush valve' may be used for this purpose.

The features of the present invention which are believed to be novel are set forth with particularity in the appended claims.

BRIEF DESCRIPTION OF THE DRAWINGS

A preferred embodiment of the present invention will be described in greater detail below with reference to the following drawings, in which.

DETAILED DESCRIPTION OF THE PREFERRED EMBODIMENT

Figure 1:
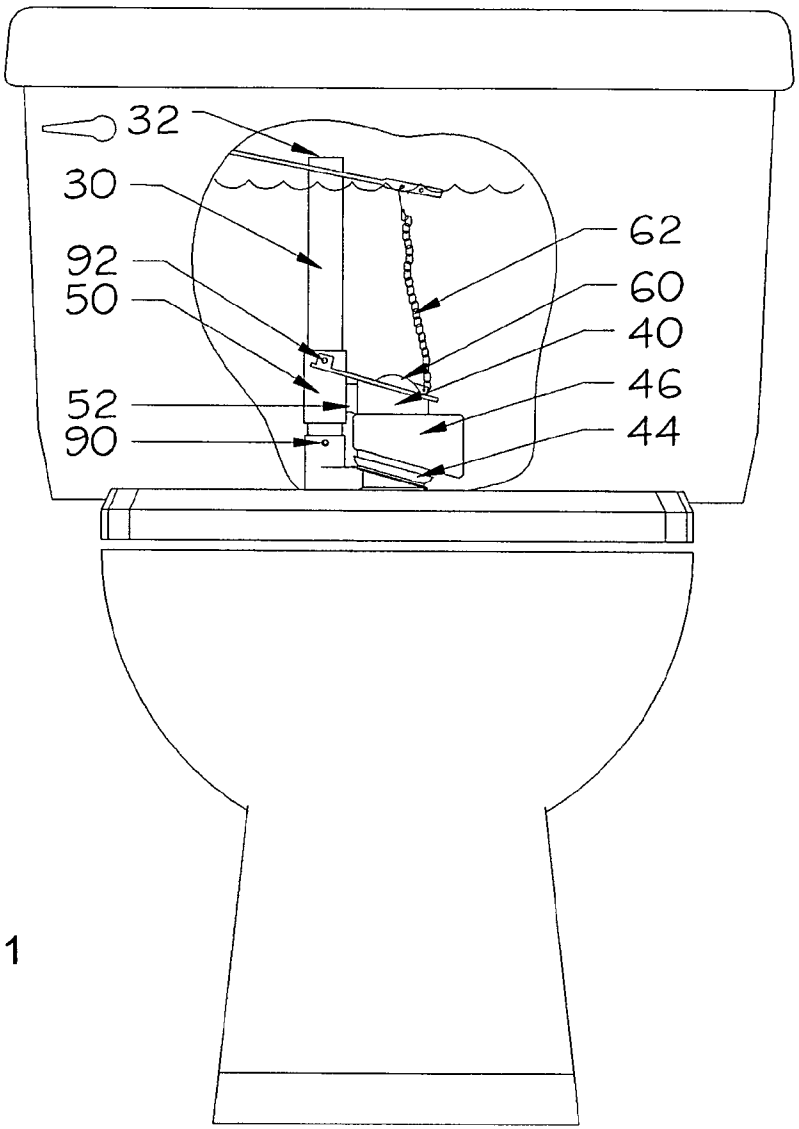
FIG. 1 is a perspective view of the dual flush system installed in a toilet.
Figure 2:
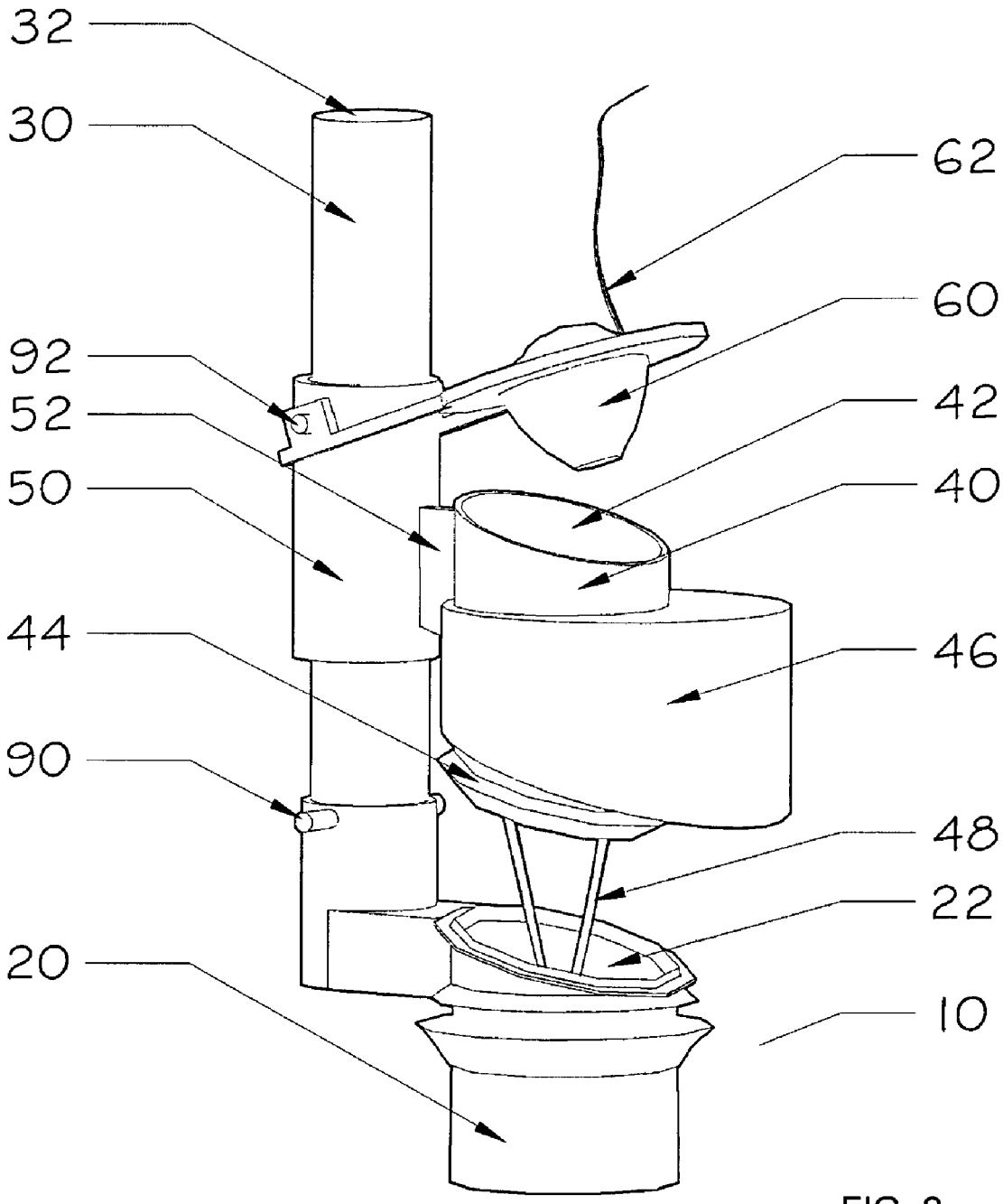
FIG. 2 is a perspective view of the dual flush system in accordance with the present invention.

FIG. 2 shows the dual flush system for a toilet installed on a conventional flush pipe 20 having a first flush outlet 22 located inside the water tank (not shown) of a conventional toilet, near the bottom wall of the water tank. Flush pipe 20 leads towards the toilet bowl (not shown), as known in the art, so as to allow water located in the water tank to selectively flow out of the tank and into the bowl through the flush pipe 20.

Near flush pipe 20, there is conventionally provided an upright overflow tube 30 having an overflow tube inlet 32. Overflow tube 30 merges with flush pipe 20 at the bottom end of overflow tube 30 to convey water towards the toilet bowl if the water level in the water tank rises above the position of the overflow tube inlet 32.

Figure 5:
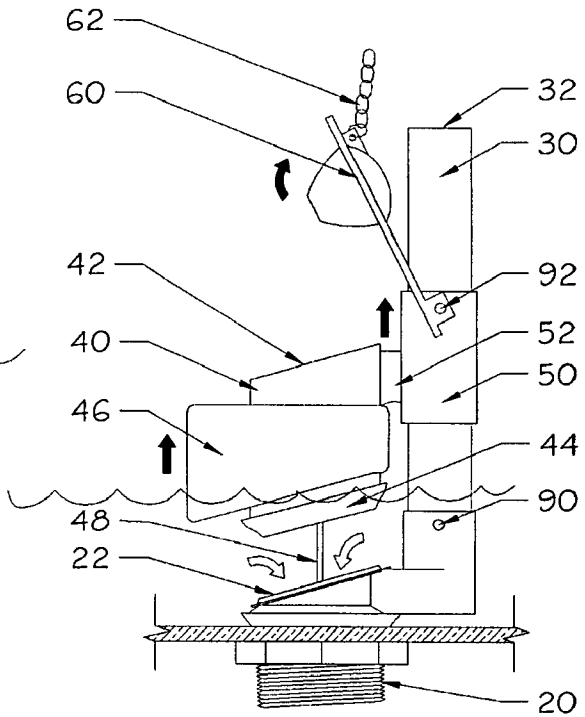
FIG. 3 to FIG. 5 are side views of the dual flush system, showing the device in a closed, partially opened and completely opened condition, respectively.
Figure 4:
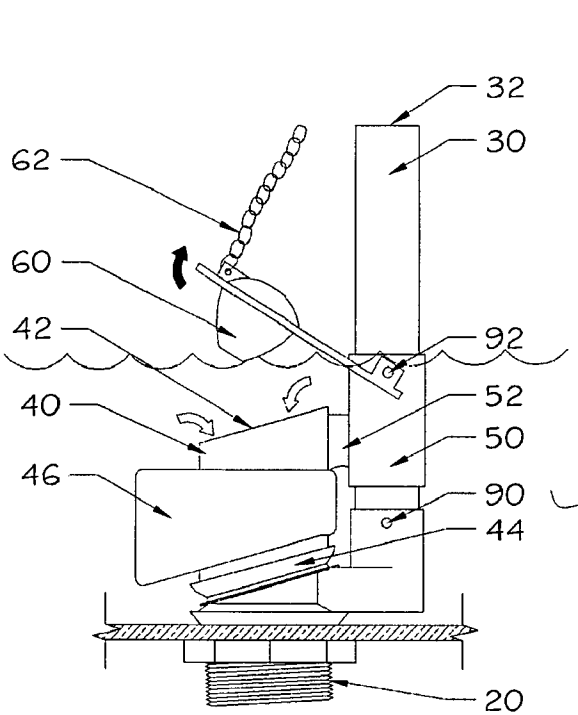
Figure 3:
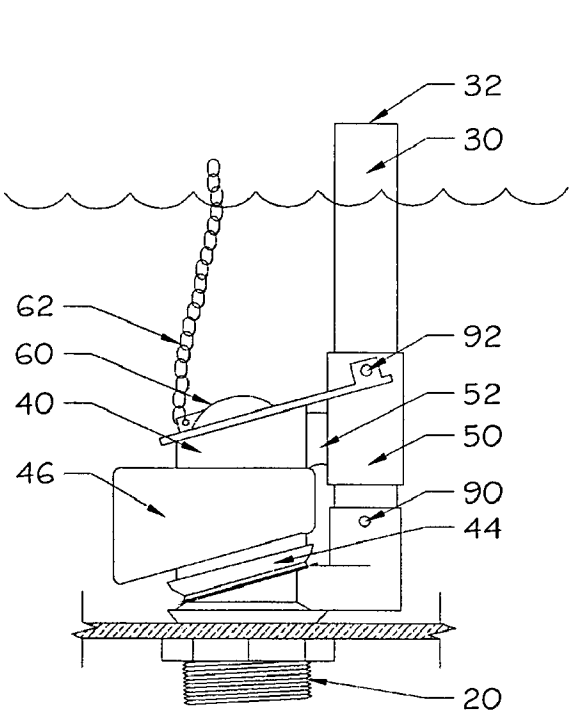
Figure 6:
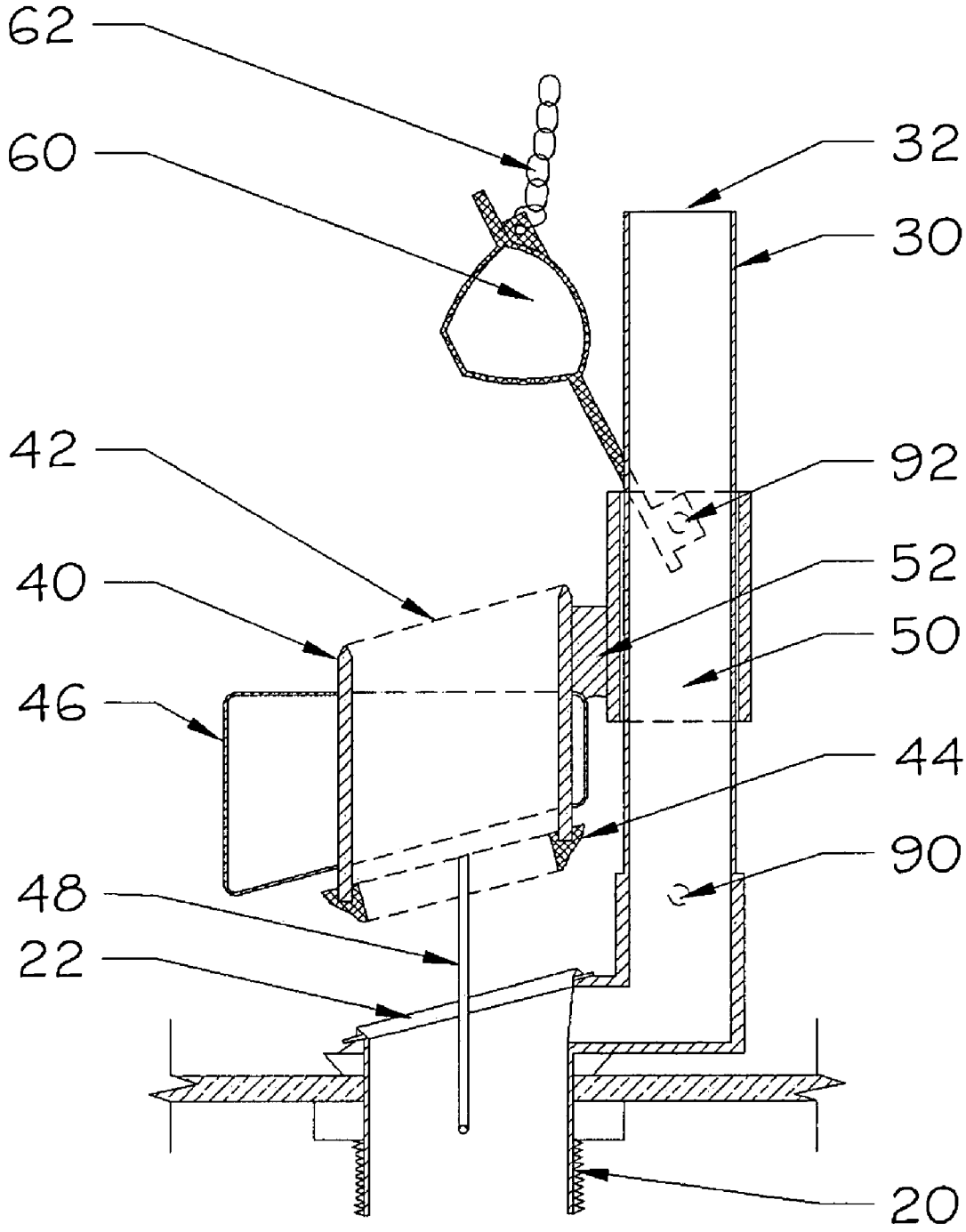
FIG. 6 is a cross side view of the dual flush system.
Figure 7:
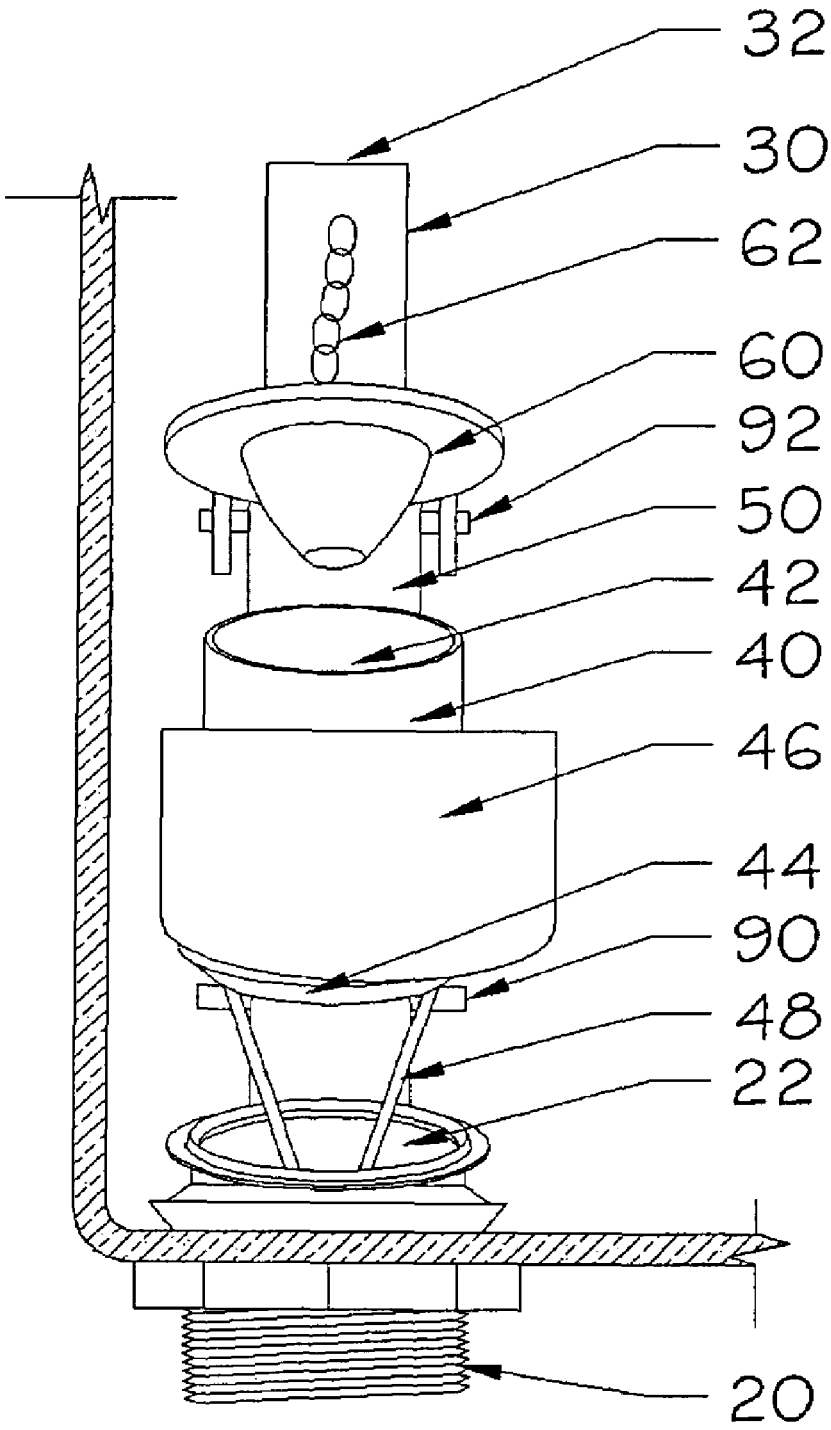
FIG. 7 is a front view of the dual flush system.

Still in FIG. 2, there is provided, according to the present invention, a movable guide part 50 that is more particularly mounted to and slidable along an overflow tube 30, as detailed hereinafter. Guiding part 50 carries a cylindrical, hollow flush pipe extension 40 that is integrally attached to guiding part 50 by means of a rigid member 52. An buoyant member 46 is carried by the flush pipe extension 40 wherein the buoyancy is provided with a tight cavity enclosing air or a buoyant material. Flush pipe extension 40 defines a second flush outlet 42 and a bottom opening 44, respectively. The bottom opening 44 is capable of sealed engagement with the first flush outlet 22 for selectively forming therewith an extended flush pipe member within the toilet water tank. In other words, when flush pipe extension 40 operatively engages the flush pipe 20, the two pipes become coextensive. By means of the sliding engagement of guiding part 50 along the overflow tube 30, flush pipe extension 40 is movable between a lower position shown in FIGS. 3 and 4, in which its bottom opening 44 rests on and sealingly engages the first flush outlet 22. The upper position is shown in FIGS. 2 and 5, in which the flush pipe extension 40 is located spacedly above flush pipe 20, and in which the flush pipe extension 40 clears the first flush outlet 22.

A tank-ball 60 is pivotally attached by means of a pair of pins 92 to guiding part 50, near its upper end. The tank-ball 60 can move from a seated position shown in FIG. 3, where it sealingly engages the second flush outlet 42 of flush pipe extension 40 to selectively close the access to flush pipe extension 40; to a lifted position shown in FIGS. 2, 4 and 5, where it is lifted spacedly over the flush pipe extension 40 and it clears the second flush outlet 42 to allow water to flow therethrough. A lift chain 62 is attached at its bottom end to tank-ball 60 and to a lever (not shown) pivotally mounted to the water tank and controlled by a flush handle (not shown), similarly to prior art devices. The tank ball 60 may be a standard one or an adjustable tank ball allowing a more precise control of the amount of water to flush such as the one shown in U.S. Pat. No. 5,966,749.

A V-shaped alignment arm 48 is formed of two downwardly convergent rods attached at their spaced-apart top ends to the flush pipe extension bottom opening 44 and attached to each other at their bottom ends. Alignment arm 48 projects downwardly away from the flush pipe extension 40. The bottom end of the alignment arm 48 is destined to extend within the flush pipe 20 in at least most positions of guiding part 50 along overflow tube 30.

Figure 8:
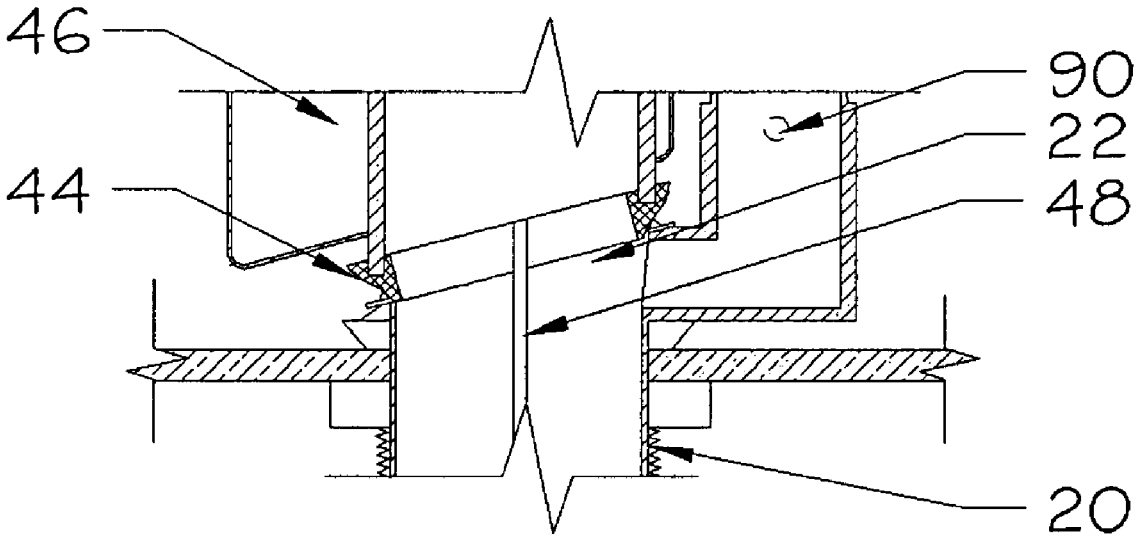
FIG. 8 is a cross side view of a first embodiment of the bottom opening of the dual flush system.

FIG. 8 shows a first embodiment of the bottom opening 44 having sealing function provided with an angular section.

Figure 9:
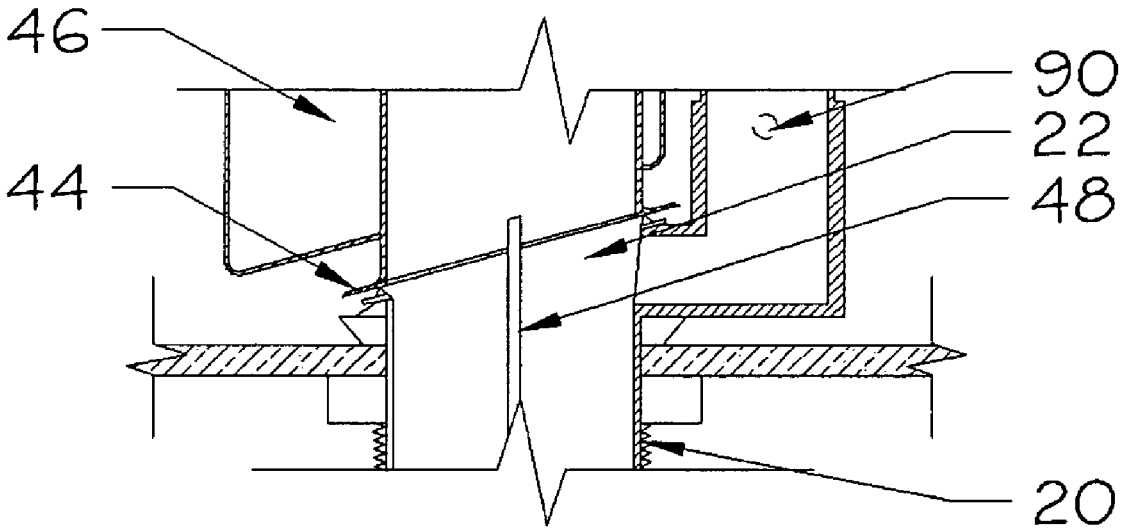
FIG. 9 is a cross side view of a second embodiment of the bottom opening of the dual flush system.

In FIG. 9, another embodiment for the bottom opening 44 is shown, wherein the sealing function is provided by a sheet-like piece.

Figure 10:
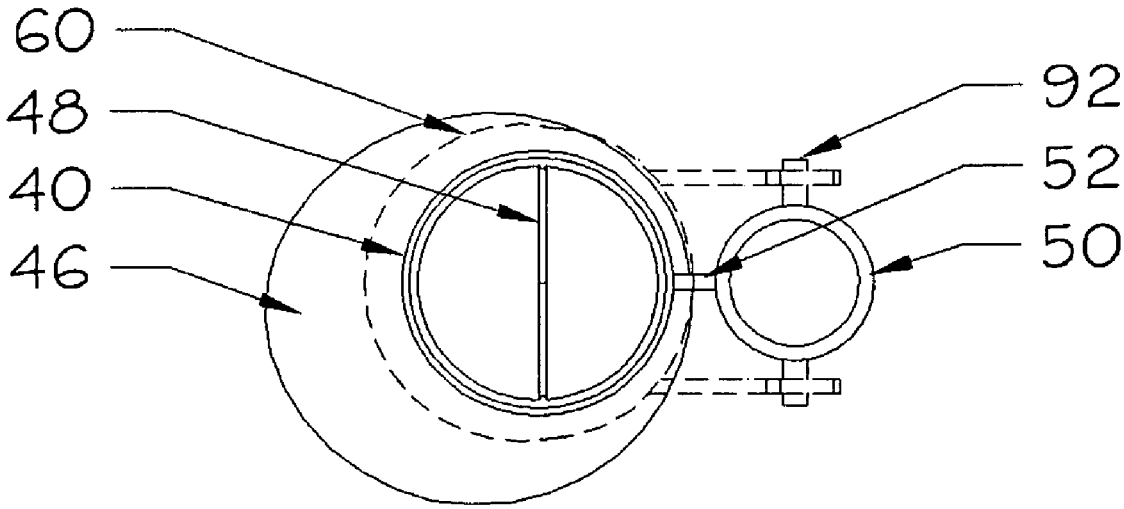
FIG. 10 is a top view showing the buoyant member.

FIG. 10 shows an embodiment of the buoyant member 46 which has an elliptical shape with a center line displaced from the center line of the second flush outlet 42.

Figure 11A:
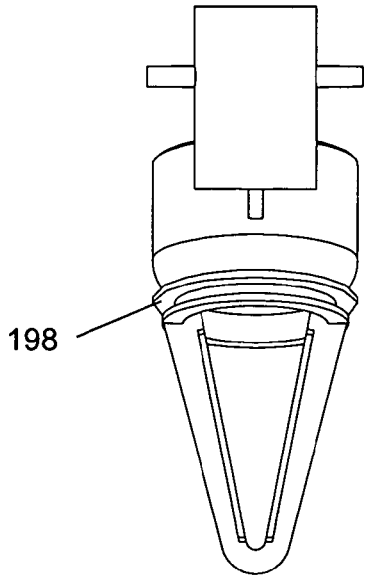
FIGS. 11*a*, 11*b* and 11*c* are, respectively, a rear view, a side view and a bottom view showing another way to attach the buoyant member to the flush pipe extension and another way to seal the flush pipe to the flush outlet.
Figure 11B:
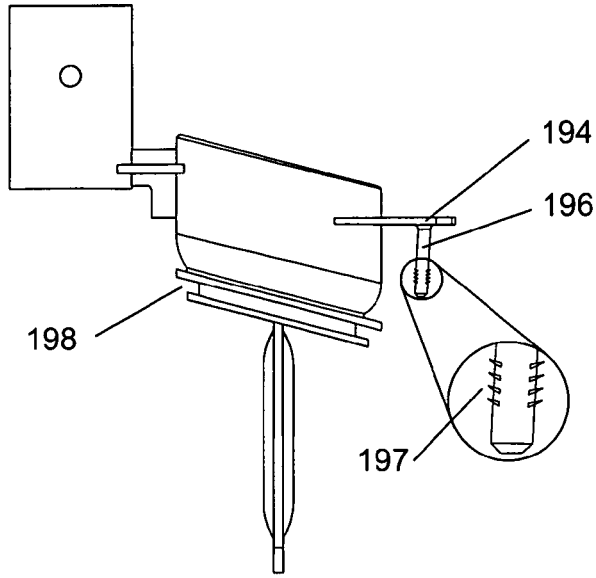

In FIGS. 11*a* to 11*b*, another embodiment is shown for the buoyant member. The buoyant member 146 is attached on one side of the flush pipe extension 40. The buoyant member 146 is connected to the flush pipe extension 40 with a pin 196 which is inserted in the hole 199 of the buoyant member 146. The pin 196 comprises gripping means 197 helping to maintain the buoyant member 146 in place. The pin 196 is preferably leaning toward the flush pipe extension 40 to help the buoyant member 146 to stay in place when inserted. Indeed, the portion of the buoyant member 146 comprised between the pin 196 and the flush pipe extension is forced between the latter, and it is necessary to apply a force to remove the buoyant member 146.

The pin 196 is fixed to the buoyant member support 194 which is fixed to the flush pipe extension 40.

Figure 11C:
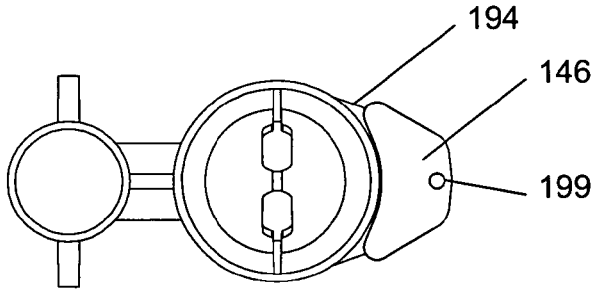
Figure 12A:
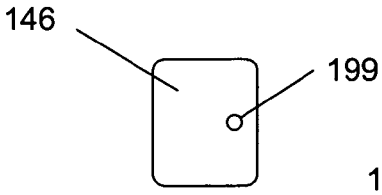
FIGS. 12*a* and 12*b* are top views showing other embodiments for the buoyant member.
Figure 12B:
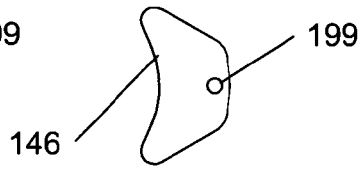
Figure 13:
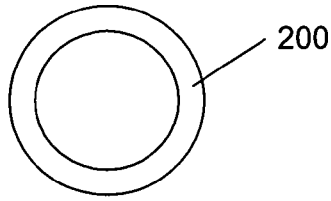
FIG. 13 is a top view showing a sealing member.

The FIGS. 11*a* to 11*c* show also another embodiment to seal the flush pipe extension 40 to the first flush outlet (not shown). The sealing member 200 (shown in FIG. 13) is inserted in the groove 198 which will maintain the sealing member in place. The sealing member 200 has an annular form and the groove 198 has a complementary shape to receive it. The sealing member 200 is preferably made of evazote foam but may be made from any another material suitable to seal the flush pipe extension to the first flush outlet.

Although preferred embodiments of the invention have been described in detail herein and illustrated in the accompanying figures, it is to be understood that the invention is not limited to these precise embodiments and that various changes and modifications may be effected therein without departing from the scope or spirit of the present invention.

The invention claimed is:

1. A dual flush system for use on a toilet of the type having a toilet bowl, a water tank, a tank ball, a lift chain and a first flush actuator, wherein said tank ball is adapted to be lifted by said lift chain by actuating said first flush actuator, said water tank being connected to the toilet bowl by means of a flush pipe having a first flush outlet in said water tank and an overflow tube having an overflow tube inlet, said overflow tube connected to said flush pipe at the bottom end of said overflow tube, said first flush outlet being sealed with said tank-ball, said dual flush system comprising a tubular flush pipe extension having a second flush outlet and a bottom opening for coextensively engaging said flush pipe at said first flush outlet, wherein flushing through both said first flush outlet and said second flush outlet is controlled by rotating said first flush actuator, and wherein both said flush pipe extension and said tank ball are lifted with said lift chain, wherein said flush pipe extension further comprises means to connect a buoyant member to said flush pipe extension, wherein said means to connect said buoyant member is a pin attached to a support member which is attached to said flush pipe extension, said buoyant member comprising a hole to receive said pin.

2. The dual flush system for a toilet of claim 1, wherein said tank ball is an adjustable tank ball allowing the selection of the volume of water to be flushed through said second outlet.

3. The dual flush system for a toilet of claim 1, wherein said second flush outlet is adapted to sealingly receive said tank-ball.

4. The dual flush system for a toilet of claim 1, wherein the height of said second flush outlet defines a volume of water to be selectively flushed.

5. The dual flush system for a toilet of claim 1, wherein said flush pipe extension comprises a buoyant member.

6. The dual flush system for a toilet of claim 1, wherein said pin leans toward said flush pipe extension.

7. The dual flush system for a toilet of claim 1, wherein said pin comprises gripping means to hold said buoyant member on said pin.

8. The dual flush system for a toilet of claim 1, wherein said dual flush system further comprises a guide part and a rigid part, said flush pipe extension being connected to said guide part by said rigid member.

9. The dual flush system for a toilet of claim 8, wherein said guide part is adapted to be movably fit along a substantially vertical element.

10. The dual flush system for a toilet of claim 9, wherein said substantially vertical element is said overflow tube.

11. The dual flush system for a toilet of claim 9, wherein said guide part is a tube.

12. The dual flush system for a toilet of claim 1, wherein said flush pipe extension has a first position in which said bottom opening sealingly engages said first flush outlet.

13. The dual flush system for a toilet of claim 1, wherein said flush pipe extension has a second position in which said bottom opening is spaced from said first flush outlet.

14. The dual flush system for a toilet of claim 1, further comprising a second flush actuator.

15. The dual flush system for a toilet of claim 14, wherein said second flush actuator is connected to said tank-ball and wherein the activation of said second flush actuator lift up said tank-ball to flush a volume of water corresponding to the height of said second flush outlet.

16. The dual flush system for a toilet of claim 12, wherein said first position is reached when said first flush actuator is moved from its rest position to a first predetermined position.

17. The dual flush system for a toilet of claim 13, wherein said second position is reached when said first flush actuator is moved from its rest position to a second predetermined position.

18. The dual flush system for a toilet of claim 1, wherein said flush pipe extension further comprises an alignment arm projecting downwardly from said bottom opening and extending in said flush pipe, wherein said extremity of said alignment arm is free.

19. The dual flush system for a toilet of claim 8, wherein said guiding part further comprises pins adapted to receive said tank-ball.

20. The dual flush system for a toilet of claim 18, wherein said alignment arm is v-shaped.

21. The dual flush system for a toilet of claim 1, wherein said first flush actuator is rotated in the same direction for flushing through said first flush outlet and through said second flush outlet.

* * * * *